United States Patent [19]

Williams

[11] Patent Number: 4,785,553

[45] Date of Patent: Nov. 22, 1988

[54] MULTILANE OVEN

[75] Inventor: Jimmie Williams, Mexico, N.Y.

[73] Assignee: Miller Brewing Company, Milwaukee, Wis.

[21] Appl. No.: 70,360

[22] Filed: Jul. 7, 1987

[51] Int. Cl.[4] ..... F26B 15/18

[52] U.S. Cl. ..... 34/105; 34/236; 432/239; 198/442; 198/836

[58] Field of Search ..... 34/105, 208, 216, 217, 34/236; 198/442, 836; 432/239, 245, 246; 256/40, 42, 47, 37

[56] References Cited

U.S. PATENT DOCUMENTS

| | | | |
|---|---|---|---|
| 406,642 | 7/1889 | Frost | 256/40 |
| 490,946 | 1/1893 | Clive | 256/42 |
| 506,559 | 10/1893 | Small | 256/37 |
| 512,885 | 1/1894 | Kiler | 256/40 X |
| 598,886 | 2/1898 | Jackson | 256/42 X |
| 675,043 | 5/1901 | Hornback | 256/42 X |
| 775,931 | 11/1904 | Ott | 256/42 X |
| 843,893 | 2/1907 | Hawkins | 99/360 |
| 1,125,382 | 1/1915 | Nye | 34/208 X |
| 1,484,629 | 2/1924 | Eberhart et al. | 432/122 |
| 1,669,474 | 5/1928 | France | 198/836 |
| 2,029,558 | 2/1936 | Chalmers | 113/115 |
| 2,129,569 | 9/1938 | Delay | 256/40 X |
| 2,157,131 | 5/1939 | Hothersall et al. | 34/105 X |
| 2,329,312 | 9/1943 | Weeks | 193/39 |
| 2,404,232 | 7/1946 | Hunter | 198/836 X |
| 3,517,794 | 6/1970 | Babunovic | 198/31 |
| 3,565,234 | 2/1971 | Birdsong | 198/33 |
| 4,081,078 | 3/1978 | Richardson et al. | 209/82 |
| 4,283,245 | 8/1981 | Benoit | 156/476 |
| 4,394,902 | 7/1983 | Mazzoni | 198/436 |
| 4,492,571 | 1/1985 | Miura | 432/225 |

FOREIGN PATENT DOCUMENTS

| | | | |
|---|---|---|---|
| 1397017 | 6/1975 | United Kingdom | 198/442 |

*Primary Examiner*—Samuel Scott
*Assistant Examiner*—Carl D. Price
*Attorney, Agent, or Firm*—Quarles & Brady

[57] ABSTRACT

A divider for a tunnel oven converts the moving surface of the oven into at least two lanes so that two or more different brands or types of articles can be dried without intermixing. The divider comprises at least one cable guide mounted to the tunnel oven housing at the inlet and the outlet of the oven. The cable guides extend downwardly to a point adjacent to and above the moving surface. A cable extends the length of the oven from one cable guide to the other and effectively divides the moving surface of the oven into two lanes. In a preferred embodiment there is a pulley wheel at one end for reversing the direction of the cable to provide a two strand divider and a ratchet wheel for adjusting the cable.

1 Claim, 1 Drawing Sheet

FIG. 1
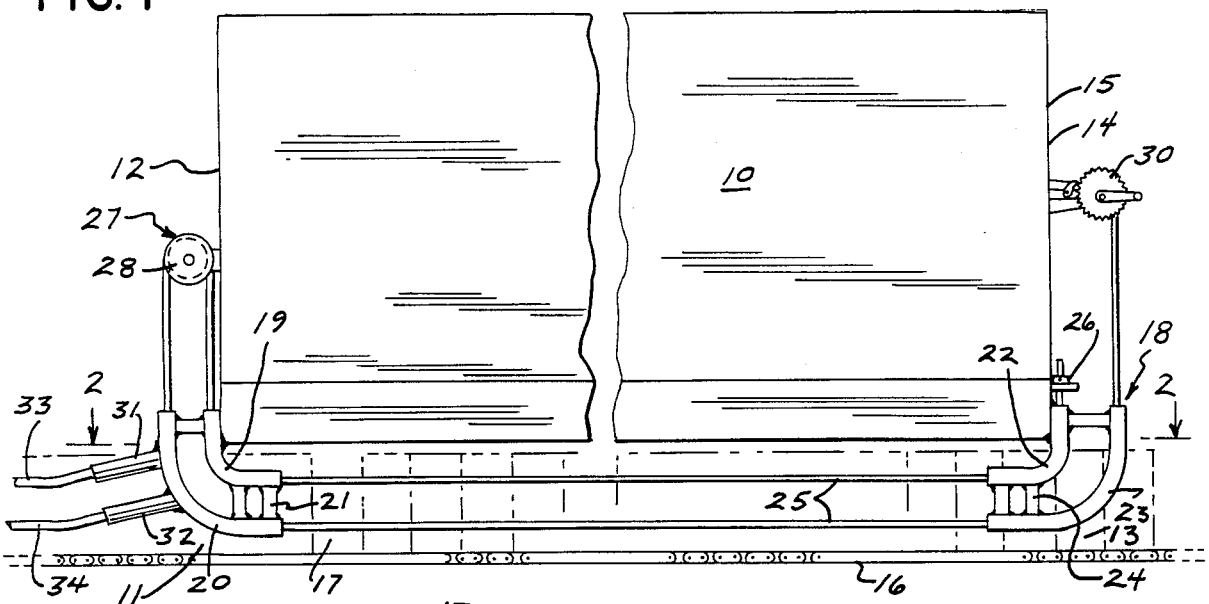
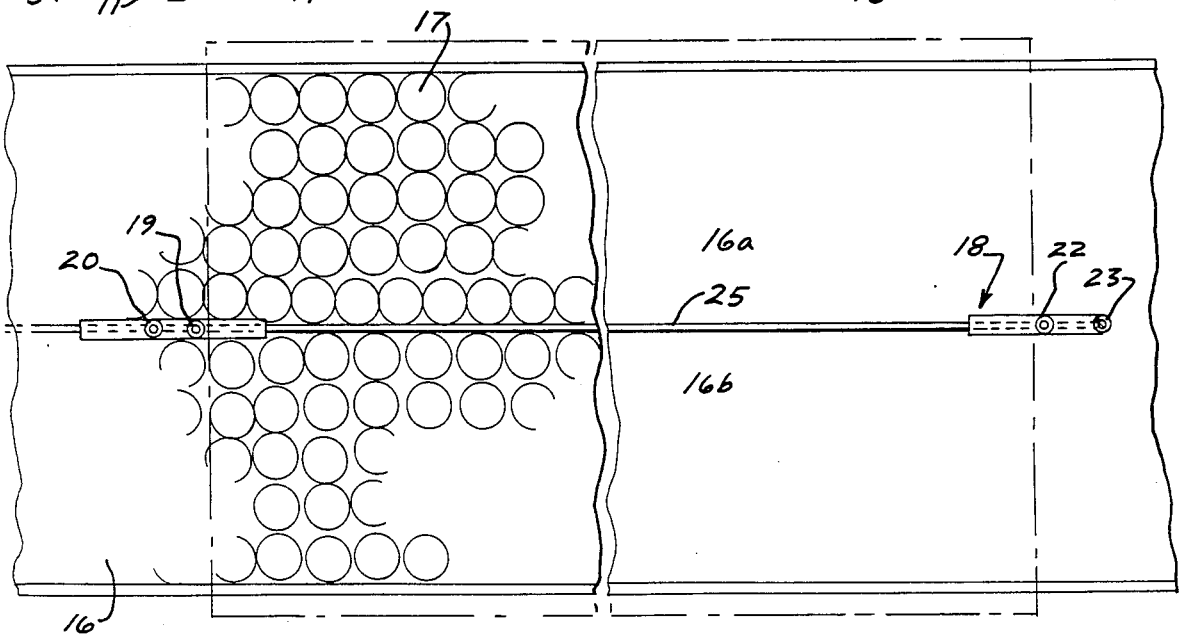
FIG. 2
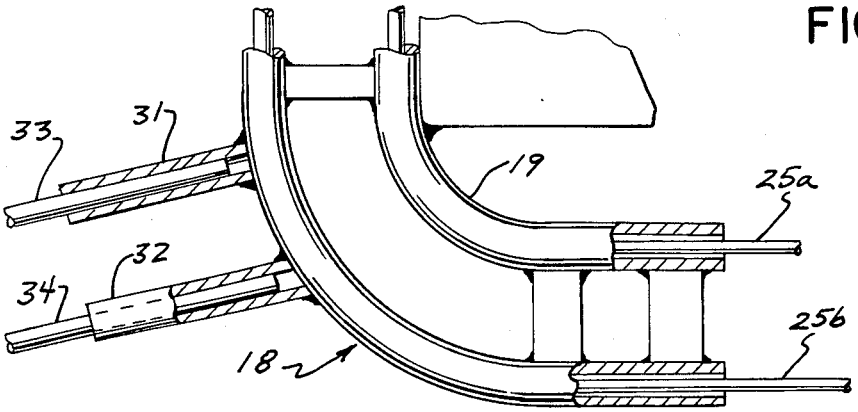
FIG. 3

MULTILANE OVEN

TECHNICAL FIELD

The present invention relates to drying ovens. More particularly, it relates to tunnel ovens in which an item enters the oven at one end, travels through the oven on a moving surface and exits the oven at the other end.

DESCRIPTION OF THE PRIOR ART

Tunnel ovens are well known and are used in many industries to bake or dry items. Tunnel ovens basically comprise a tunnel-like housing, a moving surface for conveying the items to be treated through the tunnel and some type of source of heating gas or radiation located either above or below the moving surface. The tunnel oven may also include exhaust systems and other features.

In the brewing industry, tunnel ovens are used for drying inks and curing coatings on cans or bottles prior to filling them with beer. The tunnel ovens used in the brewing industry can be as long as 60 feet in length and the items, of necessity, move relatively slowly through the oven to insure total drying.

Modern breweries simultaneously produce more than one brand of beverage or both bottles and cans of the same brand product. Therefore, there usually is a need for a supply of dry containers for different brands or a need for both dry cans and dry bottles.

The need for the dry containers of more than one kind can be supplied by the brewery having more than one tunnel oven or by running the different containers through the drying oven in batches. It would be advantageous to be able to run more than one brand or type of container through a tunnel oven at the same time; however, it would have to be done without intermixing the containers.

SUMMARY OF THE INVENTION

It is the primary object of the present invention to provide an improved tunnel oven which can be used to simultaneously and continuously dry more than one brand or type of container without intermixing them.

It is a further object to disclose a simple, inexpensive divider means for a tunnel oven which can be used to effectively divide the moving surface of the oven into two or more lanes so that more than one different brand or type of container can be simultaneously dried.

The manner in which the present invention achieves the aforementioned and other objects will become apparent to those skilled in the art from the drawings and description.

The present invention comprises a divider means for effectively dividing the moving surface of the tunnel oven into two or more separate and distinct lanes. The divider means basically comprises at least one cable guide mounted above the moving surface of the oven at each of the inlet and outlet of the oven; and a cable extending through first one guide and the length of the oven to and through the other guide. The cable guides are positioned so that the cable is at a height above the moving surface and below the top of the containers being dried so that the moving surface moves freely and is effectively divided into two lanes.

In a preferred embodiment, the divider means also includes means mounted on the one end of the oven for reversing the direction of the cable and another cable guide at each end of the oven so that in effect a two strand cable divider is obtained. It also includes means for anchoring the cable at one end and means for adjusting the cable, such as a ratchet wheel and crank.

BRIEF DESCRIPTION OF THE DRAWINGS

In the drawings:

FIG. 1 is a side view, partially in section, of a tunnel oven equipped with the divider means of the present invention;

FIG. 2 is a top view of the oven of FIG. 1; and

FIG. 3 is an enlarged partial view of the divider means at the inlet of the oven of FIG. 1.

DESCRIPTION OF THE PREFERRED EMBODIMENT

In the drawings, a tunnel oven 10 is seen with an inlet 11 at one end 12 and an outlet 13 at the other end 14. The oven 10 includes a tunnel like housing 15 and a moving surface 16 upon which objects such as containers 17 can be transported through the oven 10. The oven 10 also is provided with drying means not shown, for providing drying gas or radiation to the objects.

The tunnel 10 of the drawings differs from prior art tunnel ovens in that it is equipped with divider means 18 which will be described in detail.

As seen in FIGS. 1 and 2 the divider means 18 basically comprises a first pair of cable guides 19, 20 at the inlet end 12. The guides 19 and 20 are spaced apart and joined together to form a unitary structure by arms 21. A second pair of cable guides 22, 23 which are similarly spaced apart are joined together by arms 24 and secured to the oven 10 at the outlet end 14. Both pair of cable guides extend downwardly from the tunnel 15 to a point above the moving surface 16 but below the top of the container 17.

As seen in FIG. 3 the divider means 18 is positioned to divide the moving surface 16 of the oven 10 into two separate and distinct lanes generally referred to as **16*a* and 16*b***.

Referring back to FIGS. 1 and 2 it can be seen that the divider means 18 further includes a cable 25 which extends from an anchor 26 on the outlet end 12 through the cable guide 22 the entire length of the oven (e.g. 60-feet) to and through the cable guide 19. From the cable guide 19 the cable 25 travels to a cable reversing means 27 which may be a pulley wheel 28. The cable 25 is wrapped a half wrap around the pulley wheel 28 to change its direction 180°; it then passes through cable guide 20 the length of the oven 10 to and through cable guide 23 and on to the cable tightening means 29 which as shown is a ratchet wheel mechanism 30.

As can be seen best in FIGS. 1 and 3, the divider means 18 has two strands **25*a* and 25*b* of the cable 25 which are suspended below the tunnel 15. Turning to FIG. 1 it is seen that both strands 25*a* and 25*b* are below the top of containers 17 and adjacent to but not touching the moving surface 16 so that the divider 18 does not interfere with the movement of surface 16. When a single divider means 18 is in place as seen in FIG. 2 the moving surface 16 is effectively divided into two lanes 16*a* and 16*b*** so that two different brands or types of containers can be simultaneously dried without the containers or items becoming intermixed.

In the preferred embodiment of the invention the cable guide 20 at the inlet end 11 is provided with a pair of upstream projecting rail receiving socket members 31 and 32. The socket members 31 and 32 cooperate with rails 33 and 34, respectively, to keep the different brands or types of containers to be dried separate before they enter the inlet end 11 of the oven 10. Although not shown, downstream projecting rail receiving socket members and rails could be employed, if desired, to help keep the dried containers from becoming intermixed.

It will be appreciated by those skilled in the art that a number of modifications and changes may be made without departing from the spirit and scope of the invention. For example, more then one divider can be employed if it is desired to have more than two lanes for drying. Furthermore, the components including cable guides, cable direction reversing and cable tightening means can take different forms. Therefore, it is intended that the scope of the invention not be limited except by the claims.

I claim:

1. In a tunnel oven having a top, a bottom, a first end partially closed except for an inlet adjacent the bottom, a second end partially closed except for an outlet adjacent the bottom, and a moving surface arranged for conveying articles to be treated through the oven from the inlet to the outlet, the improvement which comprises divider means which effectively divides the moving surface in the oven into two lanes so that two different types of articles can be simultaneously conveyed without being intermixed, said divider means comprising a first pair of arcuate tubular cable guide members extending down from a portion of the first end into the inlet to a level below an upper extent of the articles being conveyed and above the moving surface; a second pair of arcuate tubular cable guide members extending down from a portion of the second end into the outlet to a level below the top of the articles being conveyed and above the moving surface, each of said members of each of said pair of tubular cable guides being spaced apart from the other member of the pair and parallel thereto; means for anchoring a cable attached to said second end of the tunnel oven and means for adjusting a cable including a ratchet wheel mechanism affixed to one said second end of the tunnel oven; means for reversing the direction of a cable comprising a pulley wheel affixed to the first end to the tunnel oven; and, a cable attached at one end to said means for anchoring said cable, said cable extending therefrom through the lumen of a first tubular cable guide member of one of said pairs of cable guide members, through the entire length of the oven and through the lumen of a first tunnel cable guide member of the second of said pairs to and about the pulley wheel and back 180° through the lumen of the second tunnel cable guide member of said second pair through the length of the oven and through the lumen of the second tunnel cable guide member of the first pair to the means for adjusting to which the second end of the cable is attached, said divider means effectively providing a vertical barrier for dividing the moving surface of the oven into two lanes without interfering with its movement.

* * * * *